United States Patent [19]

Hickman

[11] 4,292,863

[45] Oct. 6, 1981

[54] AUTOMATIC SOCKET EJECTOR

[76] Inventor: Jack L. Hickman, 1809 Plaza Way, Walla Walla, Wash. 99362

[21] Appl. No.: 175,431

[22] Filed: Aug. 5, 1980

Related U.S. Application Data

[63] Continuation-in-part of Ser. No. 119,932, Feb. 8, 1980, abandoned.

[51] Int. Cl.[3] ..... B25B 13/58

[52] U.S. Cl. ..... 81/184; 81/177 G

[58] Field of Search ..... 81/177 G, 184; 279/1 E, 279/79

[56] References Cited

U.S. PATENT DOCUMENTS

| | | | |
|---|---|---|---|
| 1,660,989 | 2/1928 | Carpenter | 81/177 G UX |
| 3,138,984 | 6/1964 | Penner | 81/184 |
| 3,208,318 | 9/1965 | Roberts | 81/177 G |
| 3,393,587 | 7/1968 | Jolliff et al. . | |
| 3,532,013 | 10/1970 | Haznar | 81/177 G |
| 3,638,519 | 2/1972 | Rebold | 81/177 G |
| 3,762,245 | 10/1973 | Smyers et al. | 81/177 G |
| 3,777,596 | 12/1973 | Smyers et al. | 81/177 G |
| 3,815,451 | 6/1974 | Penner | 81/184 |
| 3,881,376 | 5/1975 | Wright | 81/177 G X |

*Primary Examiner*—James G. Smith

*Attorney, Agent, or Firm*—Wells, St. John & Roberts

[57] ABSTRACT

An automatic ejector for a socket, utilizing a spring-loaded pin arranged outwardly adjacent to the drive fitting of a tool that engages interchangeable sockets. A spring biased latch holds the pin in a retracted position during use of the socket, and is manually releasable to effect positive axial movement of the socket when removal is desired.

10 Claims, 12 Drawing Figures

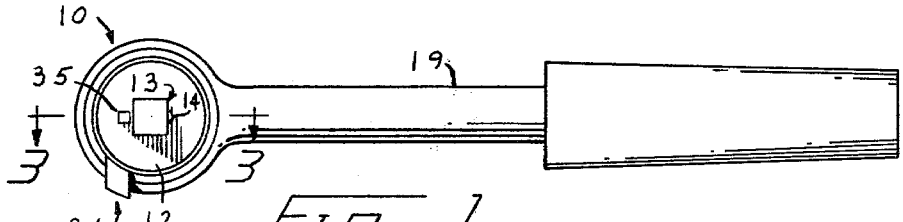
FIG 1
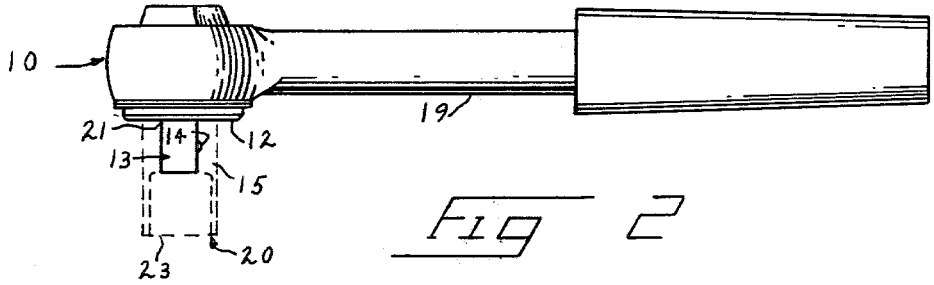
FIG 2
FIG 3
FIG 4
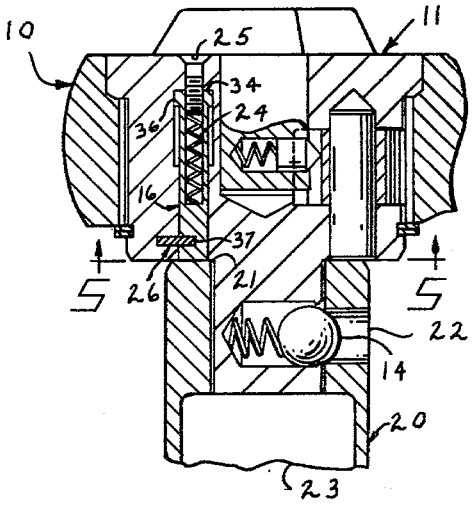
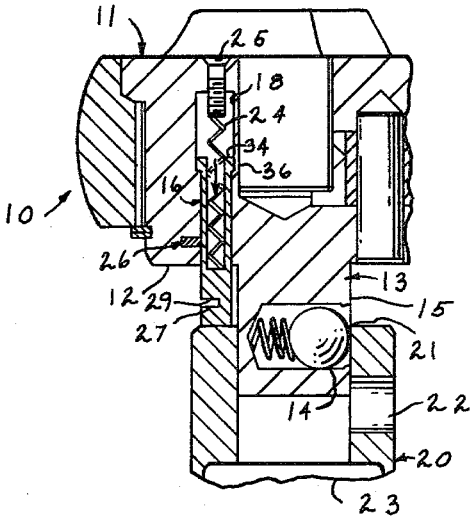
FIG 5
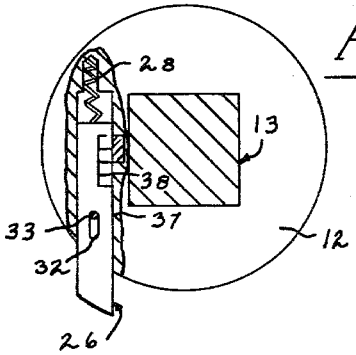
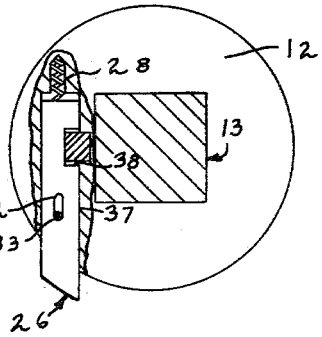
FIG 6

AUTOMATIC SOCKET EJECTOR

This is a Continuation-In-Part of copending patent application Ser. No. 119,932 filed Feb. 8, 1980, now abandoned.

BACKGROUND OF THE INVENTION

This relates to a mechanism for automatically removing sockets from a tool such as a wrench. The sockets are positively ejected from the tool by manually releasable spring pressure.

Driving tools and wrenches for sockets are well known in the art. A variety of tools, adaptors and attachments are commonly used for mounting of sockets used in the turning of threaded members, such as connectors. The working end of the tool or adaptor is provided with a male drive fitting that can be releasably located within a complementary female recess in the socket being used.

The socket is conventionally retained on the drive fitting by a spring biased ball or detent seated within a groove or recess within the socket. Attachment and removal of the socket is sometimes difficult because of physical access limitations and the very common condition in which the socket and the hands of the user are often coated with grease or oil, making it difficult to manually grasp the socket.

A number of prior patents have disclosed means for releasing the detent on such socket drive fittings, but this does not effect any motion of the socket relative to the wrench. It is still necessary to axially pull the socket from the wrench by manual operations. Sockets often frictionally engage the drive fitting and make such removal difficult.

U.S. Pat. No. 3,881,376 discloses a reciprocable pin that extends through the socket carrier adjacent to the drive fitting. The outer end of the pin can be manually pushed toward the socket, which will cause the inner end of the pin to push the socket outwardly along the drive fitting. However, there is no mechanical advantage involved in this arrangement, and the force applied to the socket is perpendicular to the locking forces by which the detent retains the socket in place.

The object of the present disclosure is to provide automatic ejection of a socket by spring force, thereby assuring prompt removal of a socket each time the device is used. Effective use of the device does not depend upon the strength of the user, nor upon adequate physical access for applying substantial force to an ejection mechanism. The present apparatus utilizes a spring biased removal pin which is latched by a releasable slide that frees the pin for ejection movement.

DESCRIPTION OF THE DRAWINGS

FIG. 1 is a bottom view of a wrench incorporating the invention;

FIG. 2 is a side elevation view of the wrench, showing a mounted socket in phantom;

FIG. 3 is an enlarged fragmentary elevation section taken along line 3—3 in FIG. 1;

FIG. 4 is similar to FIG. 3, showing a second condition of the ejection pin;

FIG. 5 is a fragmentary sectional view taken along line 5—5 in FIG. 3 with a portion broken away to show the slide;

FIG. 6 is a view similar to FIG. 5, showing the release position of the slide latch;

DESCRIPTION OF THE PREFERRED EMBODIMENTS

Figure 7:
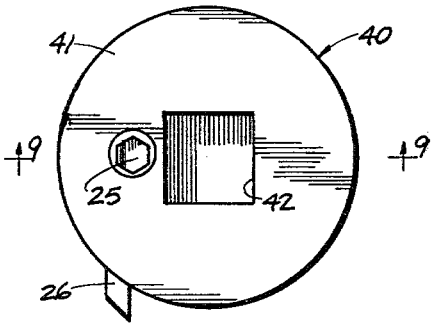
FIG. 7 is a top view of an adaptor incorporating the invention.
Figure 8:
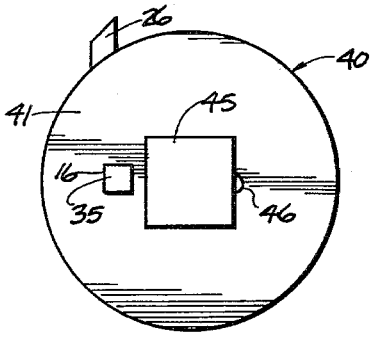
FIG. 8 is a bottom view of the adaptor.

FIGS. 1-6 illustrate this invention as incorporated within a tool shown as a conventional ratchet wrench of the type used for reversibly turning interchangeable sockets. The details of such wrenches are well known and are exemplified by the disclosure in U.S. Pat. No. 3,393,587, which is hereby incorporated by reference.

FIGS. 7-12 show the invention included within the structure of a second form of tool, illustrated as an adaptor which is interposed in the drive train between a manual or power-operated tool and a rotatable socket. It is to be understood that this invention can be incorporated within any form of tool operably used adjacent to a socket, including a wrench, handle, adaptor, extension, ratchet, universal joint or other drive fitting.

In the illustrated tool or wrench 10 (FIGS. 1-6), socket 20 is turned by pivotable or rotational movement of a central body or socket carrier 11 having an outer face 12 and an integral drive fitting 13 that projects outwardly from face 12. The drive fitting 13 is polygonal and typically has a square cross-sectional configuration. It includes longitudinal side surfaces 15 complementary to the conventional drive opening 21 of socket 20. The socket 20 further includes a coaxial socket opening 23 at its working end.

The drive fitting 13 includes a spring biased ball or detent 14 which yieldably fits within transverse retaining grooves 22 or an aperture in the socket drive opening 21. Detent 14 maintains socket 20 in place on the drive fitting 13 during use of wrench 10.

The socket carrier 11 is operably supported within a handle 19 by a ratchet mechanism that interconnects socket carrier 11 and handle 19 for transmission of turning force to socket 20 in a selected direction of rotational movement. The details of the ratchet mechanism are not essential to an understanding of this invention. Many conventional ratchet devices, both internal and external to the handle 19 and socket carrier 11 are well known in this area of hand tools.

This disclosure is concerned with removal of a socket 20 from driving engagement on the fitting 13 of any form of driving tool. Sockets are often used under space retrictions which make their manual removal difficult. They also are often used in the vicinity of lubricants which make the usually smooth outer surface of the socket slippery. The present improvement provides an apparatus for mechanically assisting such removal without requiring that the socket be directly grasped.

As shown, an ejector pin 16 having an inner end 34 and an outer end 35 is slidably mounted within the socket carrier 11 for relative movement parallel to the socket axis. Pin 16 is movable between a retracted position (FIG. 3) wherein its outer end 35 is adjacent the carrier face 12 and an extended position (FIG. 4)

wherein end 35 protrudes outward from face 12 at a location alongside drive fitting 13. It is the movement of pin 16 from its retracted position to its extended position that is utilized for ejection or removal of socket 20 from its working engagement on drive fitting 13.

A first biasing means, in the form of a compression spring 24, is operably mounted between the socket carrier 11 and ejector pin 16. Spring 24 is positioned within an aperture 18 formed through the socket carrier 11 and slidably guiding the pin 16. Spring 24 is retained within socket carrier 11 by a flush screw 25 threadably engaged within the end of aperture 18. As shown, both the pin 16 and aperture 18 have a square cross-sectional configuration to prevent pivotal or rotational movement of pin 16 relative to socket carrier 11. The inner end 34 of pin 16 is enlarged so as to abut an inner shoulder 36 at the base of aperture 18, which limits outward movement of pin 16 relative to carrier 11. This defines the longitudinal location of pin 16 when in its extended position. To provide room for adequate spring length, the inner end 34 of pin 16 can be recessed to surround a portion of spring 24. Spring 24 must have sufficient strength to overcome the resistance to axial movement of socket 20 provided by the detent 14.

The pin 16 is selectively held in its retracted position by latch means in the form of a movable slide 26. The slide 26 is mounted within socket carrier 11 so as to be engageable with a transverse external shoulder 29 formed as part of a groove or slot 27 across the ejector pin 16. The latch means, in the form of the illustrated slide 26, is operably engageable with the ejector pin 16 when the pin is in its retracted position, (FIG. 5). In this condition it normally retains the pin 16 in such retracted position when a socket 20 is mounted on the drive fitting 13. The latch means is manually actuable (FIG. 6) for selectively disengaging the ejector pin 16 to permit the pin to move to its extended position (FIG. 4) by operation of spring 24.

The slide 26 is movably guided within a complementary slot formed through the slot carrier 11 within a plane perpendicular to the central socket axis. The slide moves in a straight path parallel to its length. It includes a longitudinal side edge 37 that intersects the path of movement of the ejector pin 16 as the pin 16 moves between its respective retracted and extended positions. The groove 27 is shaped complementary to the side edge 37 of slide 26 so that the side edge 37 can be received within groove 27 to interlock the pin 16 and slide 26.

The side edge 37 along slide 26 is transversely relieved at its inner end along a section of the slide 26 adequate to free the ejector pin 16 for movement. Slide 26 further includes a longitudinal slot 32 which receives a fixed pin 33 in the socket carrier 11. The respective ends of slot 27 define the limits of longitudinal movement of slide 26 relative to socket carrier 11. In its outer position (FIG. 5) the edge 37 is overlapped under shoulder 29 to prevent outward movement of pin 16. In its inner position (FIG. 6) the relief provided at 38 clears the periphery of pin 16 and permits it to move outward to its extended position.

The slide 26 is normally urged to its outer position by a second biasing means in the form of a compressive spring 28 operatively engaged between the socket carrier 11 and the inner end of slide 26.

It is believed that the operation of the device is evident from the above description and the accompanying drawings. As shown in FIG. 3, the mounting of a socket 20 on the drive fitting 13 causes the inner end of the socket to move the ejector pin 16 inwardly to its retracted position in opposition to spring 24. When this position has been reached and socket 20 is properly fitted on the drive fitting 13, the ejector pin 16 will be latched in place by outward movement of slide 26 under the biasing force provided by spring 28. Both will remain in this condition until the latch is manually released by inward movement. A suitable manual button may be provided at the outer end of slide 26 so that the user can push slide 26 inwardly when ejection of a socket is desired.

To remove a socket 20 from the drive fitting 13, the slide 26 is pushed inwardly. This causes slide 26 to move within a plane perpendicular to the central socket axis and locates the relieved portion 38 of edge 37 in alignment with the periphery of pin 16. This disengages shoulder 36 and slide 26, allowing pin 16 to be moved outward due to the biasing force of spring 24. The outward movement of pin 16 will overcome the detent force and positively free socket 20 from the drive fitting 13.

FIGS. 7–12 show the ejection system within a tool shown as an adaptor which can be mounted to any type of drive tool whether manually operated or power driven. It eliminates the need for redesign of a wrench or driving implement, while incorporating the ejector structure described above.

Figure 9:
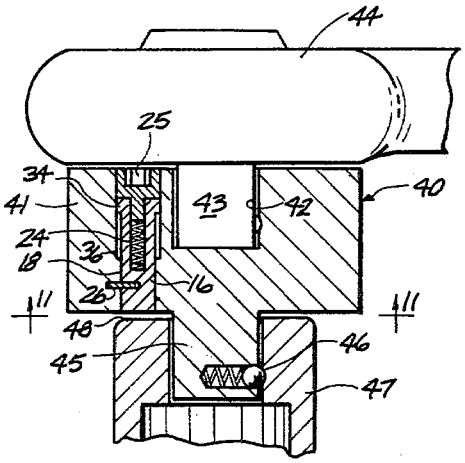
FIG. 9 is a sectional view taken along line 9—9 in FIG. 7, showing portions of a driving wrench and socket.
Figure 10:
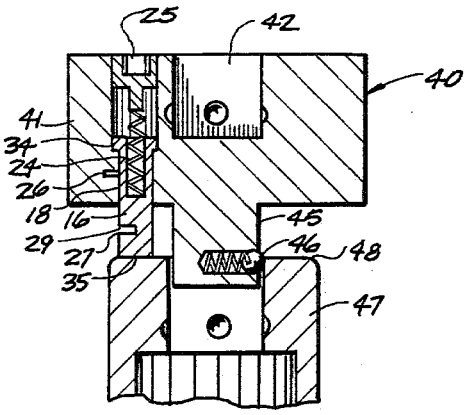
FIG. 10 is a sectional view along line 9—9 in FIG. 7 showing a second condition of the ejection pin.
Figure 11:
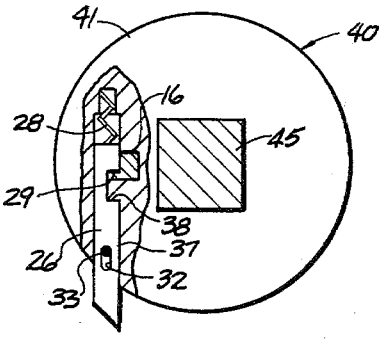
FIG. 11 is a fragmentary sectional view taken along line 11—11 in FIG. 9.
Figure 12:
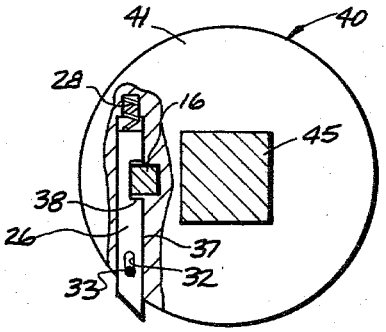
FIG. 12 is a view similar to FIG. 11, showing the slide latch in released condition.

Adaptor 40 includes a rigid solid body 41 having a cylindrical outer shape. Its inner end includes a square recess 42 adapted to receive the drive fitting 43 of a conventional wrench 44 (FIG. 9). Its outer end has a coaxial drive fitting 45, including a detent 46, adapted to engage a conventional socket 47 having a transverse inner end surface 48.

Since the ejector mechanism is flush to both transverse surfaces of body 41 when loaded, the adaptor requires minimum additional axial spacing between wrench 44 and socket 47.

The ejector details are identical to those previously described with respect to FIGS. 3–6. Identical reference numerals identify the corresponding parts illustrated in FIGS. 7–12.

The adaptor 40 can be used next to any socket, regardless of the type of tool being used to turn it. Socket 47 is removed by release of pin 16, which moves outward under spring pressure. Slide 26 serves as a "trigger" controlling movement of the spring biased pin 16.

Modifications might be made with respect to the details of this apparatus, depending upon the particular tool within which it is to be incorporated. For these reasons, the above details are intended as being illustrative only.

Having described my invention, I claim:

1. In a tool for engaging interchangeable sockets each having a drive end with a polygonal drive opening and a working end with a socket opening;

a body having an outer face and an integral drive fitting projecting outward from said face, said drive fitting being complementary to the drive opening of a socket and being formed about a center axis;

an ejector pin having an inner end and an opposed outer end, said ejector pin being slidably mounted within the body for relative movement parallel to said axis between a retracted position wherein its outer end is adjacent said face and an extended position wherein its outer end protrudes outward from said face at a location alongside the drive fitting;

biasing means operably connected between the body and the ejector pin for urging said ejector pin to its extended position;

and latch means movably mounted on the body and operably engageable with the ejector pin when said pin is in its retracted position for normally retaining the ejector pin in the retracted position when a socket is mounted on the drive fitting; said latch means being manually actuable for selectively disengaging the ejector pin to permit said pin to move to its extended position by operation of said biasing means.

2. A tool as set out in claim 1, further including:

interengageable stop means on said ejector pin and body for limiting outward sliding movement of the ejector pin relative to the socket carrier at said extended position.

3. A tool as set out in claim 1 wherein said latch means comprises:

a rigid slide movably mounted within the body for movement within a plane perpendicular to said axis.

4. A tool as set out in claim 1 wherein said latch means comprises:

a rigid slide movably mounted within the body for movement in a straight path located within a plane perpendicular to said axis.

5. A tool as set out in claim 1 wherein said latch means comprises:

a rigid slide movably mounted within the body for movement in a straight path located within a plane perpendicular to said axis;

said slide having a side edge intersecting the path of movement of the ejector pin as it is moved between its retracted and extended positions relative to the body.

6. A tool as set out in claim 1 wherein said latch means comprises:

a rigid slide movably mounted within the body for movement in a straight path located within a plane perpendicular to said axis;

said slide having a side edge intersecting the path of movement of the ejector pin as it is moved between its retracted and extended positions relative to the body;

said ejector pin having a groove formed transversely across it and shaped complementary to said side edge of the slide, said groove being adapted to receive the side edge to thereby interlock the ejector pin and slide.

7. A wrench as set out in claim 1 wherein said latch means comprises:

a rigid slide movably mounted within the body for movement in a straight path located within a plane perpendicular to said axis;

said slide having a side edge intersecting the path of movement of the ejector pin as it is moved between its retracted and extended positions relative to the body;

said ejector pin having a groove formed transversely across it and shaped complementary to said side edge of the slide, said groove being adapted to receive the side edge to thereby interlock the ejector pin and slide;

the side edge of said slide being transversely relieved along a length of the slide adequate to free the ejector pin for movement parallel to said axis.

8. In a tool for engaging interchangeable sockets each having a drive end with a polygonal drive opening and a working end with a socket opening;

a body having an outer face and an integral drive fitting projecting outward from said face, said drive fitting being complementary to the drive opening of a socket and being formed about a center axis;

an ejector pin having an inner end and an opposed outer end, said ejector pin being slidably mounted within the body for relative movement parallel to said axis between a retracted position wherein its outer end is adjacent said face and an extended position wherein its outer end protrudes outward from said face at a location alongside said drive fitting;

first biasing means operably mounted between the body and the ejector pin for urging said ejector pin to its extended position;

said ejector pin having a transverse external shoulder formed across it and facing toward its outer end;

latch means movably mounted on the socket carrier;

second biasing means operably mounted between the body and said latch means for urging the latch means into engagement with said shoulder when the ejector pin is in its retracted position;

and manual means outward of the body operably connected to said latch means for selectively releasing said latch means from engagement with said shoulder in opposition to said second biasing means.

9. A socket wrench for engaging interchangeable sockets, each socket having a drive end with a polygonal drive opening and a working end with a socket opening; said socket wrench comprising:

a socket carrier having an outer face and an integral drive fitting projecting outward from said face, said drive fitting being complementary to the drive opening of a socket and being formed about a center axis;

an ejector pin having an inner end and an opposed outer end, said ejector pin being slidably mounted within the socket carrier for relative movement parallel to said axis between a retracted position wherein its outer end is adjacent said face and an extended position wherein its outer end protrudes outward from said face at a location alongside the drive fitting;

biasing means operably connected between the socket carrier and the ejector pin for urging said ejector pin to its extended position;

and latch means movably mounted on the socket carrier and operably engageable with the ejector pin when said pin is in its retracted position for normally retaining the ejector pin in the retracted position when a socket is mounted on the drive fitting; said latch means being manually actuable for selectively disengaging the ejector pin to permit said pin to move to its extended position by operation of said biasing means.

10. An adapter for engaging interchangeable sockets, each socket having a drive end with a polygonal drive opening and a working end with a socket opening; said adapter comprising:

a body having an outer face and an integral drive fitting projecting outward from said face, said drive fitting being complementary to the drive opening of a socket and being formed about a center axis;

an ejector pin having an inner end and an opposed outer end, said ejector pin being slidably mounted within the body for relative movement parallel to said axis between a retracted position wherein its outer end is adjacent said face and an extended position wherein its outer end protrudes outward from said face at a location alongside the drive fitting;

biasing means operably connected between the body and the ejector pin for urging said ejector pin to its extended position;

and latch means movably mounted on the body and operably engageable with the ejector pin when said pin is in its retracted position for normally retaining the ejector pin in the retracted position when a socket is mounted on the drive fitting; said latch means being manually actuable for selectively disengaging the ejector pin to permit said pin to move to its extended position by operation of said biasing means.

* * * * *